US010145655B2

(12) United States Patent
Rockenfeller et al.

(10) Patent No.: US 10,145,655 B2
(45) Date of Patent: Dec. 4, 2018

(54) MULTILAYERED COMPOSITE BALLISTIC ARTICLE

(71) Applicant: ROCKY RESEARCH, Bloulder City, NV (US)

(72) Inventors: Uwe Rockenfeller, Boulder City, NV (US); Kaveh Khalili, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 145 days.

(21) Appl. No.: 14/810,360

(22) Filed: Jul. 27, 2015

(65) Prior Publication Data

US 2017/0030685 A1 Feb. 2, 2017

(51) Int. Cl.
*F41H 5/04* (2006.01)

(52) U.S. Cl.
CPC ..... *F41H 5/0471* (2013.01)

(58) Field of Classification Search
CPC .... F41H 5/0421; F41H 5/0428; F41H 5/0457; F41H 5/04; F41H 5/0478; F41H 5/0464; F41H 5/0471; F41H 5/0485; B29K 229/0091; D06M 11/00; B32B 5/024; B32B 5/026; B32B 5/147; B32B 5/22; B32B 2260/023; B32B 2571/00; B32B 2571/02; B32B 2255/20; B32B 2255/205; B32B 2255/26; B32B 2260/04; B29L 2031/768
USPC ..... 2/2.5; 427/427, 419.3; 156/278; 442/86, 135, 59, 65, 70, 71, 72, 68, 66
See application file for complete search history.

(56) References Cited

U.S. PATENT DOCUMENTS

| | | | |
|---|---|---|---|
| 4,311,630 | A | 1/1982 | Humphrey |
| 4,351,878 | A | 9/1982 | Harper-Tervet |
| 5,389,121 | A | 2/1995 | Pfeffer |
| 5,970,843 | A | 10/1999 | Strasser |
| 6,224,842 | B1 | 5/2001 | Rockenfeller |
| 6,736,194 | B2 | 5/2004 | Rockenfeller |
| 7,648,757 | B2 | 1/2010 | Rockenfeller |
| 7,722,952 | B2 | 5/2010 | Rockenfeller |
| 8,314,038 | B2 | 11/2012 | Rockenfeller |
| 2004/0096708 | A1 | 5/2004 | Bottger |
| 2004/0118271 | A1 | 6/2004 | Puckett |
| 2005/0029262 | A1 | 2/2005 | Bosik |
| 2006/0147710 | A1 | 7/2006 | Rockenfeller et al. |
| 2011/0107904 | A1 | 5/2011 | Queheillalt |
| 2011/0174144 | A1 | 7/2011 | Kuchinsky |

(Continued)

OTHER PUBLICATIONS

Invitation to Pay Additional Fees, and where applicable, Protest Fees, issued in PCT/US2016/31297 dated Jul. 15, 2016.

(Continued)

*Primary Examiner* — Camie S Thompson
(74) *Attorney, Agent, or Firm* — Knobbe, Martens, Olson & Bear LLP

(57) ABSTRACT

A multi-paneled penetration resistant composite comprises a layered panel configuration that mitigates transmission of impact stress between adjacent, or proximate, penetration resistant composite panels. For example, areas of reduced density, provided by an intermediate stress mitigation panel positioned between adjacent composite panels and varying densities of composite layers within a composite panel, can mitigate transmission of stress between adjacent, or proximate, composite panels.

27 Claims, 7 Drawing Sheets

(56) References Cited

U.S. PATENT DOCUMENTS

| | | | |
|---|---|---|---|
| 2012/0178323 | A1 | 7/2012 | Rockenfeller |
| 2013/0284003 | A1 | 10/2013 | Dodworth |

OTHER PUBLICATIONS

International Search Report and Written Opinion issued in PCT/US2016/31297 dated Sep. 15, 2016.
Department of Defense Handbook; Composite Materials Handbook, vol. 1, Ch. 3, pp. 2-3; Jun. 17, 2002.

MULTILAYERED COMPOSITE BALLISTIC ARTICLE

TECHNICAL FIELD

Aspects relate to multilayer composite panels that are resistant to ballistic penetration, or configured to reduce the speed of a ballistic projectile. In some aspects, an anti-ballistic article includes two panels of woven ballistic layers surrounding a compressible panel.

BACKGROUND

Many different uses have been found for penetration resistant materials. For example, penetration resistant materials can be used to protect storage containers, vehicles and personnel from damage by projectiles. These materials also generally protect from penetration from flying shrapnel and the like.

Many types of penetration resistant materials, such as Kevlar®, are made from high strength fibers. These fibers can be integrated with, or layered into, articles of clothing such as vests or parts of vests. In addition, the fibers can be used as part of a woven or knitted fabric. For other applications, the fibers are encapsulated or embedded in a composite material.

Because there is a trade-off in weight versus ballistic penetration resistance, many materials of a specified weight are unable to stop, or greatly slow down, a ballistic projectile. Moreover, it is known that stacking multiple layers of anti-ballistic composites generally increases resistance to ballistic penetration. However the multiple layers also result in an increase in overall weight of the completed panels. The overall weight of the panels becomes increasingly important for panels that are used, for example, on anti-ballistic armor that is wearable. Weight can also be an important factor for large vehicles, such as trucks, ships or aircraft because additional weight reduces fuel efficiency and speed.

SUMMARY

Aspects of the invention relate to the discovery of a non-linear relationship between the number of stacked panels within a penetration resistant material and the reduction of a projectile's velocity as it travels thought the anti-ballistic article. While not being limited by any particular theory, it is believed that as a projectile passes through one or more layers of material in a multilayer panel, its force may result in stress propagation that may "pre-stress" subsequent panels within the ballistic article. This pre-stress force on the subsequent panels may reduce the ability of adjacent interior panels to slow the ballistic projectiles as compared to exterior panels. For example, when a ballistic projectile contacts a first outer panel, it may deform one or more layers in that panel. That deformation may result in a shock wave, or pieces of the first panel, impacting or cracking and weakening the adjacent layer (or layers) in the adjacent panel. This pre-stress on the layers of adjacent panels may result in the adjacent panel being unable to provide its full potential of ballistic protection.

This may be particularly true for multilayer composite panels, wherein the interlocking of crystals between adjacent layers of composite material may reduce the ductility of each layer. Thus, deformation of a first layer results more easily in pre-stress of adjacent layers of the panel. Accordingly, if one ballistic composite panel alone provides a reduction of x feet per second (ft/s) to the entrance velocity of an impacting projectile, two adjacent panels may provide a reduction of less than 2x ft/s.

In some cases, large projectiles can be traveling at impact velocities greater than 8,000 ft/s. While it may not be feasible to completely stop such projectiles, in some embodiments it is only necessary to slow the velocity below a pre-determined threshold. This velocity reduction can reduce the damage, and potential for explosions, of the equipment being protected by the anti-ballistic materials. For example, some embodiments relate to impact resistant cargo containers for missiles, other energetic materials, or other weaponry. While anti-ballistic containers using embodiments of anti-ballistic articles described herein may not be able to completely prevent a ballistic projectile from piercing the outer shell of the container, the articles may be able to reduce the speed of the projectile below the threshold that would cause an explosion of the weaponry upon impact. As discussed above, there is a relationship between the weight of the panels within an anti-ballistic article and the ability of the panels to prevent penetration. In some embodiments it may be more desirable to have a reduced weight container that only slows certain ballistic projectiles to below a predetermined threshold. In other embodiments, the container may be designed to be heavier, but have a sufficient number and/or configuration of panels to prevent penetration of ballistic projectiles into the interior of the container.

Due, in part, to the non-linear relationship between the number of composite panels in the anti-ballistic article and the projectile velocity reduction capabilities of each panel, as well as the number of panels in the anti-ballistic article and the projectile velocity reduction capabilities of the article, achieving the needed velocity reduction while satisfying weight restrictions on anti-ballistic armor can be very difficult. In order to address the above-described issues, embodiments of the invention relate to a multi-paneled penetration resistant article having a panel configuration and/or intra-panel layer configuration that mitigates transmission of impact stress between adjacent, or proximate, penetration resistant composite panels. For example, areas of reduced density, provided by one or both of an intermediate stress mitigation region or panel positioned between adjacent composite panels and varying densities of composite layers within a composite panel, can mitigate transmission of stress between adjacent, or proximate, composite panels.

In one embodiment, an intermediate layer can be positioned between two penetration resistant composite layers to mitigate or eliminate propagation of stress from a first impact layer to a second impacted layer. Thus, the stack of the two penetration resistant composite layers and intermediate layer can provide for increased resistance to impacting projectiles compared to a stack of two penetration resistant composite layers placed directly adjacent to one another. In some implementations, such a configuration approaches a linear relationship between number of penetration resistant composite layers and projectile velocity reduction capability.

In some embodiments comprising a number of penetration resistant composite layers, one or more intermediate layers can be provided between each pair of adjacent composite layers. Some embodiments can further be provided with one or more hardened layers that may reduce deformation of impacted composite layers and/or stop, rather than merely slow down, an incoming projectile. The intermediate layer(s) may absorb, redirect, or otherwise mitigate impact stress so as to isolate stress to a single composite panel or to two proximate composite panels.

The penetration resistant composites described herein comprise a substrate material comprised of woven, layered or intertwined polarized strands of glass, polyamide, polyethylene, highly modulus polyethylene, polyphenylene sulfide, carbon or graphite fibers on which a selected metal, salt, oxide, hydroxide or metal hydride is polar bonded on the surface of the fibers and/or strands at concentrations sufficient to form bridges of the salt, oxide, hydroxide or hydrides between adjacent substrate strands and/or substrate fibers. The salt may be a halide in some embodiments. Single or multiple layers of the salt or hydride bonded fibers are coated with a substantially water impermeable coating material. Panels or other shaped penetration resistant products may be produced using composite layers.

The intermediate layer can be, in various implementations, a compressible material, a ductile material, a spacing matrix, a gap filled with gas or liquid, a brittle material configured to shatter at projectile impact speeds, or another material configured to redirect stress or force away from (for example, perpendicularly to) the direction of projectile travel. The intermediate layer material can be selected to be both stress-isolating and lightweight in some implementations in which the anti-ballistic article has weight constraints.

Accordingly, one aspect relates to a multi-panel ballistic composite article, comprising a first panel; a stress mitigation panel disposed adjacent to the first panel; and a second panel disposed adjacent the second panel, wherein the stress mitigation panel is configured to substantially mitigate stress propagation into the second panel caused by deformation of the first panel, and wherein the first panel and the second panel each comprise a plurality of layers of woven fabric of polarized ballistic fibers, wherein a metal salt, oxide, hydroxide or hydride are polar bonded onto the polarized ballistic fibers.

In some embodiments, the stress mitigation panel comprises a compressible material configured to substantially mitigate the stress propagation into the second panel. The compressible material can comprise foam, cloth, or woven material. In some embodiments, the stress mitigation panel comprises a frame or grid structure configured to substantially mitigate the stress propagation into the second panel. In some embodiments, the stress mitigation panel comprises a non-compressible liquid that mitigates the stress propagation into the second panel by distributing the force caused by deformation of the first panel across the entire surface area of the liquid. In some embodiments, the stress mitigation panel comprises a material configured to shatter under impact in order to substantially mitigate stress propagation into the second panel. The material configured to shatter can comprise a ceramic material. In some embodiments, the stress mitigation panel comprises a composite panel having a lower density than the density of the first panel.

A thickness of the second panel can be 10% to 50% of the overall thickness of the multi-panel ballistic composite article.

Some embodiments further include a third panel disposed adjacent to the second panel; and a fourth panel disposed adjacent the third panel, wherein the third panel is configured to substantially mitigate stress propagation into the fourth panel caused by deformation of the third panel, and wherein the fourth panel comprises a plurality of layers of woven fabric of polarized ballistic fibers, wherein a metal salt, oxide, hydroxide or hydride are polar bonded onto the polarized ballistic fibers. The third panel can comprise a compressible material configured to substantially mitigate the stress propagation into the fifth panel, and the compressible material can comprise foam, cloth, or woven material. The fourth panel can have an inner layer and an outer layer, and the outer layer can be hardened to be less prone to deformation as compared to the inner layer.

The metal salt can comprise one or more of an alkali metal, alkaline earth metal, transition metal, zinc, cadmium, tin, aluminum, or double metal salts.

The second panel can have an inner layer and an outer layer, and the outer layer can be hardened to be less prone to deformation as compared to the inner layer. A loading density of woven fabric in the outer layer can be greater than about 0.40 g/cc of open fabric volume. The outer layer can comprise a ceramic, for example silicon carbide, boron carbide, aluminum oxide, silicates, or mixtures thereof.

In some embodiments, the thickness of the first panel is the same as the thickness of the second panel. In some embodiments, the thickness of the first panel is different than the thickness of the second panel. In some embodiments, the composition of compounds bound to woven fabric of the first panel is different than the composition of compounds bound to woven fabric of the second panel.

In some embodiments, the first panel has an inner layer and an outer layer, and the inner layer is hardened to be less prone to deformation than the outer layer. A loading density of woven fabric in the inner layer can be greater than about 0.40 g/cc of open fabric volume.

A loading density salt bound to the woven fabric of the first panel and the second panel can vary from 0.2 g/cc to about 0.60 g/cc of open fabric volume. The first panel or the second panel, or both, can comprise S-2 glass, polyamide, polyphenylene sulfide, polyethylene, high modulus polyethylene, carbon or graphite fibers. The article can be sealed within a waterproof material.

In some embodiments, the composite article comprises an article of body armor, vehicle armor or panels for storage or transport containers.

BRIEF DESCRIPTION OF THE DRAWINGS

The disclosed aspects will hereinafter be described in conjunction with the appended drawings, provided to illustrate and not to limit the disclosed aspects, wherein like designations denote like elements.

DETAILED DESCRIPTION

I. Introduction

Figure 1A:
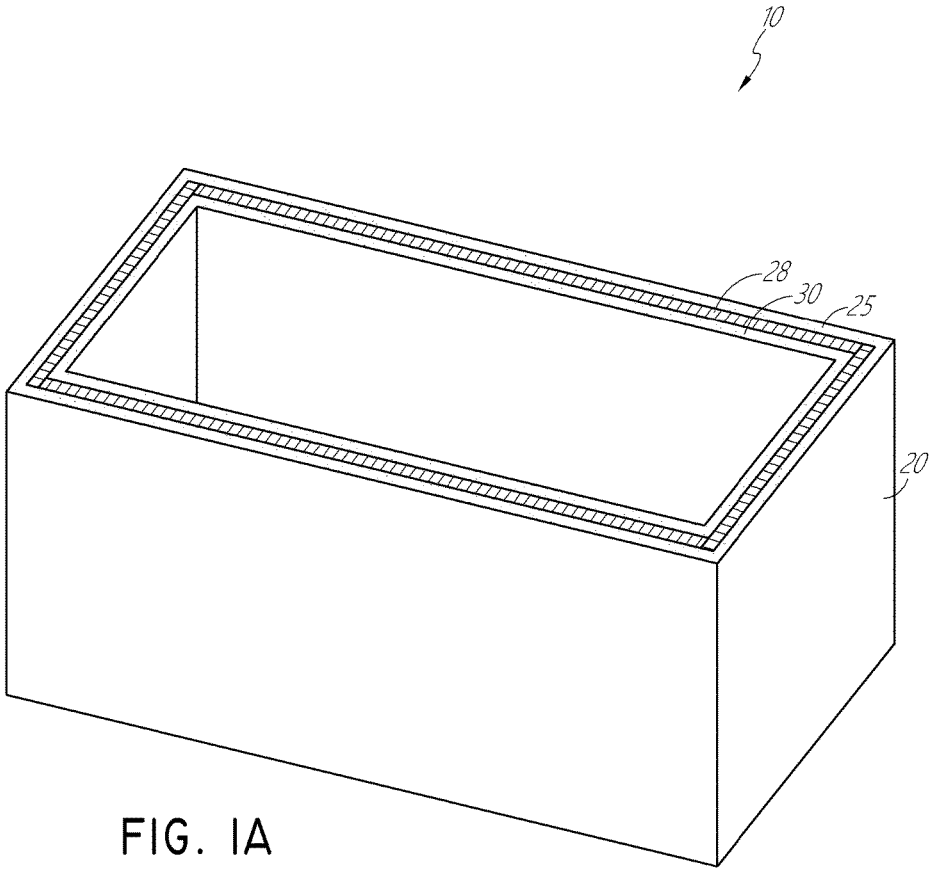
FIG. 1A illustrates an example of a projectile-resistant enclosure having walls comprising the penetration resistant composite articles described herein.

Embodiments of the invention relate to multilayered penetration resistant articles or structures having a mixed layered configuration that mitigates transmission of impact stress between different layers within the article. For example, a multilayered article may have a stress mitigation region positioned between first and second penetration resistant layers. Deformation or stress caused by a projectile impact with the first layer or layers of the article would be mitigated by the stress mitigation region so that the projectile's impact on the first layers would not substantially weaken the second layers. Thus, embodiments include ballistic panels having a mixed stack of penetration resistant layers with one or more intermediate stress mitigation regions within or between the ballistic panels. This can create an article that more effectively reduces the speed of impacting projectiles, or prevents the projectile's ability to traverse the penetration resistant layers, in comparison to articles that do not have stress mitigation regions.

Interpanel Stress Mitigation

A ballistic article may include one or more ballistic panels, with each panel having one or more composite layers having woven fibers and bonded particles as described herein. Each panel may include any number of layers of woven fabric. For example, each panel may have 1-30 layers of woven fabric. Other embodiments may have 5, 10, 15, 20, 25 or more layers. In one embodiment each panel has between 5-15 layers of woven material.

A ballistic article can include any number of panels. For example, the article may have 1, 2, 3, 4, 5, 6, 7, 8, 9, 10, 11, 12, 13, 14, 15 or more panels in some embodiments. As used herein, a panel is not limited to a planar structure, and the term panel may encompass both planar structures and non-planar (for example contoured, cylindrical, round, and edged, etc.) structures.

In one embodiment, an intermediate stress reduction or mitigation region is positioned between two adjacent penetration resistant composite panels to mitigate or eliminate propagation of stress from a first panel to a second panel. Thus, a stack of two or more penetration resistant composite panels and stress mitigation regions can provide for increased resistance to impacting projectiles compared to a stack of two or more penetration resistant composite panels placed directly adjacent one another. In some implementations, such a configuration approaches a linear relationship between the number of penetration resistant composite panels and the ability of the article to reduce the velocity of a projectile traversing the article.

The stress mitigation region can be a stress mitigation panel and made of a material selected to be both stress-isolating and lightweight, particularly in implementations in which the anti-ballistic article has weight constraints. In some implementations, a stress mitigation panel comprises a compressible material and/or ductile material. For example, one suitable material can be foam, for example open-cell foam/reticulated foam, and the like. Other suitable materials to be used in a stress mitigation panel can include porous or low-density solids, lightweight compressible materials, aramid cloth, polyethylene cloth, unimpregnated glass fiber cloth, carbon fibers, and the like. In other implementations, the stress mitigation panel can be made of a structured frame that provides an air gap between adjacent composite panels in the article. A spacing grid, matrix, or lightweight 3D knitted spacing fabric may also be used to in a stress mitigation panel to mitigate transmission of impact stress from one protective layer to another within the article. In some embodiments, the gap between adjacent composite panels can be filled with gas (for example air) or a liquid to provide mitigation of impact stress between adjacent panels within the ballistic article.

In some embodiments, the stress mitigation region comprises one or more hardened panels disposed between adjacent composite panels. The hardened panels may reduce deformation of impacted composite panels and/or stop, rather than merely slow down, an incoming ballistic projectile. In this embodiment, the force of the incoming ballistic projectile may be mitigated when the projectile contacts the hardened panel. As the projectile strikes the hardened panel, projectile's force is distributed in a direction perpendicular to its direction of travel. The intermediate hardened panel (or panels) may absorb, redirect, or otherwise mitigate impact stress so as to isolate the stress to a single composite layer, or to two or more proximate composite layers.

The hardened panels may be made of a brittle material that cracks or shatters in response to a projectile impact. This type of brittle panel may redirect and/or absorb propagation of the projectile's force as it traverses the article. The hard, brittle material may also help mitigate deformation of the impacted composite layers or panel. For example, the hardened panel may be made of ceramic material, such as boron carbide or silicon carbide. The hardened panel could also be made from other materials, such as aluminum oxide, silicates, or mixtures thereof.

In one embodiment, the hardened panels can be provided on the outermost surface of a ballistic article, which is first impacted by a projectile, in order to reduce the effectiveness of armor-piercing projectiles. Some armor piercing projectiles work by being formed in the shape of a drill bit and being fired though a barrel that is configured to rotate the projectile. This results in the projectile hitting the ballistic material with a rotational drilling action that helps the projectile cut though the ballistic material. However, a hardened outer panel on the article, such as a ceramic panel or hardened outer composite layer of the outer panel, may chip or break the tip of the armor piercing projectile and thereby reduce its ability to drill through subsequent layers and/or panels.

In other embodiments, the penetration resistant article can comprise a hardened composite layer on a back surface of a composite panel (that is, the surface opposite the impact surface). This may mitigate deformation of the final composite layer of the article and also spread any residual kinetic force of the projectile as it is exiting the penetration resistant article.

The penetration resistant articles described herein can have a plurality of composite panels in an alternating arrangement with stress mitigation panels. The composite layers in the plurality of composite panels can comprise the same substrate and bonded particles or different substrates and/or bonded particles. The plurality of composite panels may have equal or varying thicknesses relative to one another. The multi-paneled penetration resistant article can include any number of composite panels as needed to reduce the impact speed of an impacting projectile to a desired velocity.

Intrapanel Stress Mitigation

As described in more detail below, each panel of composite material may be made of a substrate material comprised of woven, layered or intertwined fibers onto which a selected metal, salt (often a halide), oxide, hydroxide or metal hydride is polar bonded. Embodiments also include stress mitigation regions within a panel, formed by regions of differing composite material densities. For example, the stress mitigation region may one or more regions within a panel having composite layers of fabric that have different densities than other regions within a multilayer composite panel. In one embodiment, regions within the panel having a lower composite density may reduce the pre-stress force caused by an impacting projectile.

As discussed below, regions within a composite panel may differ in density by a predetermined amount. One region of the panel may be 1, 3, 5, 10, 15, 20, 25, 30, 35, 40, 50 percent or more different in density than another region. For example, a multilayer panel may be built to have the first region of woven fabric layers contacted by the projectile be of a relatively high density to slow down the projectile. However, a second region of fabric layers within the panel may be made at a comparatively lower density to reduce the pre-stress force the projectile will have on adjacent regions, or panels, within the overall ballistic article. As one example, a panel with eight layers of woven fabric may have a first region of four fabric layers with a relatively high overall density. The next region of four fabric layers may have a relatively lower density to provide stress mitigation to other panels within a ballistic article.

There are a variety of ways to alter the density of regions within the composite panels. For example, changing the loading density of the metal, salt, oxide, hydroxide or metal hydride that is polar bonded on the surface of the fibers is one way to alter the density of the final woven fabric layers. Generally, a more dense composite layer of fibers will be created by using a higher loading density of complex compounds. As one example, using a loading density of 0.6 gm/cm will create relatively dense composite layers, and using a loading density of, for example, 0.2 gm/cm will create a relatively lower density composite material within the panel. Thus, higher density composite layers may be created by using a loading density of 0.8, 0.7, 0.6 or 0.5 gm/cm to load the woven fibers. Lower density fabric layers may be created by using a loading density of 0.4, 0.3, 0.2 or 0.1 gm/cm.

The density of a layers within a multi-layer region of a panel may also be determined by choosing different woven fabric materials for each layer or region. In addition, selecting different metal, salt, oxide, hydroxide or metal hydride compositions to load onto the various fabric layers may also alter the density of each layer within the panel. Changes to the density may also result from using fabrics with different weaves, weave patterns, or filament geometry of the substrate or the substrate composition.

Accordingly, in some embodiments, the composite panels can have regions of fabric layers produced by loading the woven fabric in each layer with varying salt loading densities. For example, the panel may have a first region produced by loading one or more fabric layers with a loading density of 0.6 g/cc of a metal salt, oxide, hydroxide or hydride and a second region produced by loading one or more fabric layers with a lower density of 0.2 g/cc of metal salt, oxide, hydroxide or hydride. Of course, creating composite panel regions with other densities is contemplated within the scope of the invention. Varying implementations can have several different density regions within a panel, wherein each region has layers of composite material with a different density. In some embodiments, a panel may have from two to ten regions of differing densities, preferably from two to six regions of differing densities.

For example, one embodiment may be ballistic article comprising two composite panels within each wall of the article. The first panel may have ten fabric layers, wherein the first five fabric layers were produced with a loading density of 0.6 gm/cm salt and the second five fabric layers were produced with a loading density of 0.2 gm/cm salt. The second panel may have 20 layers of fabric with each pair of layers being at a different density than their adjacent pair of layers. Thus, the second panel may have 10 layer pairs, with the pairs having been produced with salt at a loading density of 0.6, 0.5, 0.2, 0.3, 0.6, 0.3, 0.5, 0.6, 0.2, 0.6 gm/cm, respectively.

Other combinations of composite densities within each panel are also contemplated within the scope of the invention. Accordingly, the first panel may have 5, 10, 15, 20 or more different densities of final composite material within teach panel. Adjacent the first panel may be a stress mitigation region of relatively low density, and adjacent the stress mitigation region may be a second panel of 5, 10, 15 or 20 different fabric densities. In an alternative embodiment, the first and second panels are directly adjacent one another, and there is no separate stress mitigation panel disposed between the two panels of varying density.

Another related embodiment is a ballistic article with only a single panel making up a wall of the article. In this embodiment, the panel may have 10, 20, 30 or more woven fabric layers. Regions of one or more woven fabric layers may have different densities and be configured to provide stress mitigation caused by an incoming ballistic projectile. As the projectile would enter the single panel, it may traverse a first region of one or more layers having a first density, and then traverse a second region of one or more layers having a relatively lower density. As the ballistic projectile traverses the second region of one or more layers, the lower density region may provide a stress reduction by mitigating the pre-stress force of the projectile on additional layers in the panel.

In this single panel embodiment, the panel may have many different regions, with each region having a different density. The density in each region may result from producing the composite layers with different salt loading densities. The different density in each region may also result from choosing different fabric material having varying weaves, weave patterns, filament geometry or substrate composition. For example within a ballistic panel, at least one first layer of woven fabric may have a first filament diameter and at least one second layer of woven fabric may have a second, different, filament diameter. By using different filament diameters, the layers of material may be created to have differing densities. Similarly, the different layers within a panel may have different patterns of fabric weaves, wherein each weave pattern results in a composite layer with a different density. Different weave patterns may include plain, twill, satin, basket, Leno or Mock leno weaves in some embodiments.

This embodiment of a single panel may be designed to provide a greater level of impact resistance than a panel with a single loading density or composition of materials. In some embodiments, the panel may have alternating layers of greater and lesser composite densities. In some embodiments, the panel may have progressive layers of different density regions, wherein a first region of layers has a relatively high density, followed by several regions of layers with gradually reducing densities, followed by several regions of layers having gradually increasing densities.

It should be realized that the different fabric layers within a panel can, in some embodiments, have different compositions of compounds bound to the fibers. For example, one region within the panel may be made of fabric layers with bonded metal salt. Another region may have a different metal salt or a metal oxide bound to the fiber layers. Other regions may have fibers that were loaded with yet another metal salt or a hydroxide or metal hydride compounds. This allows one set of layers to be different in composition from other layers and these differing compositions may be selected to provide different densities within a multilayer ballistic panel.

Some embodiments may combine the intermediate stress mitigation regions with the varying density of composite layers within composite panels, for example in order to reduce the needed thickness of the stress mitigation panel to prevent stress propagation between adjacent panels, or to increase the anti-ballistic effectiveness of the overall article.

It should also be realized that articles within the scope of the invention may have stress mitigation regions formed within a panel, and also have stress mitigation regions disposed between different panels.

II. Overview of Example Penetration Resistant Composites

The penetration resistant layers and composite products described herein can be fabricated from a substrate material comprising woven or intertwined polarized strands or layered strands of the substrate. Such woven or intertwined substrate material incorporate or utilize elongated or continuous fibers such as fabrics or cloth or unwoven intertwined fiber materials such as yarn, rope or the like where the fibers or strands of fibers have been twisted or formed in a coherent form such as yarn or weaves of strands. Various or different weaving patterns may be used, preferably three-dimensional weaves which yield multi-directional strength characteristics as compared to two-dimensional weaves having anisotropic strength characteristics. Moreover, the substrate utilizes elongated and/or continuous fibers or filaments as opposed to chopped or loose fibers or strands in which there is no interlocking or structural pattern to the fibrous substrate. Suitable materials also include needle woven layers of substrate fiber strands. Alternatively, layers of elongated, substantially continuous fiber strands which have not been woven in a three-dimensional weave may be used. Successive layers of the fibers are preferably positioned along different axes so as to give the substrate strength in multiple directions. Moreover, such layers of non-woven fibers can be positioned between layers of woven fibers.

The substrate material of which the fiber strands are made include glass, polyamide, polyethylene, high modulus polyethylene, polyphenylene sulfide, carbon or graphite fibers. Glass fibers are a preferred fiber material, woven glass fibers being relatively inexpensive and woven glass fiber fabric easy to handle and process in preparing the composites. The glass fibers may be E-glass and/or S-glass, the latter having a higher tensile strength. Glass fiber fabrics are also available in many different weaving patterns which also makes the glass fiber material a good candidate for the composites. Carbon and/or graphite fiber strands may also be used. Polyamide materials or nylon polymer fiber strands are also useful, having good mechanical properties. Aromatic polyamide resins (aramid resin fiber strands, commercially available as Kevlar® and Nomex®) are also useful. Yet another useful fiber strand material is made of polyethylene, polyphenylene sulfide, commercially available as Ryton®, or high modulus polyethylene, commercially available as Spectra® (Honeywell International, Morris Township, N.J.). Combinations of two or more of the aforesaid materials may be used in making up the substrate, with specific layered material selected to take advantage of the unique properties of each of them. The substrate material, preferably has an open volume of at least about 30%, and more preferably 50% or more, up to about 90%.

The surface of the fibers and fiber strands of the aforesaid substrate material may be polarized. Polarized fibers are commonly present on commercially available fabrics, weaves or other aforesaid forms of the substrate. If not, the substrate may be treated to polarize the fiber and strand surfaces. The surface polarization requirements of the fiber, whether provided on the substrate by a manufacturer, or whether the fibers are treated for polarization, should be sufficient to achieve a loading density of the salt on the fiber of at least about 0.3 grams per cc of open substrate volume in one embodiment, whereby the bonded metal salt bridges adjacent fiber and/or adjacent strands of the substrate. Polarity of the substrate material may be readily determined by immersing or otherwise treating the substrate with a solution of the salt, drying the material and determining the weight of the salt polar bonded to the substrate. Alternatively, polar bonding may be determined by optically examining a sample of the dried substrate material and observing the extent of salt bridging of adjacent fiber and/or strand surfaces. Even prior to such salt bonding determination, the substrate may be examined to see if oil or lubricant is present on the surface. Oil coated material may in some circumstances substantially negatively affect the ability of the substrate fiber surfaces to form an ionic, polar bond with a metal salt or hydride. If surface oil is present, the substrate may be readily treated, for example, by heating the material to sufficient temperatures to burn off or evaporate the undesirable lubricant. Oil or lubricant may also be removed by treating the substrate with a solvent, and thereafter suitably drying the material to remove the solvent and dissolved lubricant. Substrates may also be treated with polarizing liquids such as water, alcohol, inorganic acids, e.g., sulfuric acid.

The substrate may be electrostatically charged by exposing the material to an electrical discharge or "corona" to improve surface polarity. Such treatment causes oxygen molecules within the discharge area to bond to the ends of molecules in the substrate material resulting in a chemically activated polar bonding surface. Again, the substrate material should be substantially free of oil prior to the electrostatic treatment in some embodiments.

In one embodiment, one or more particles comprising metal salt, metal oxide, hydroxide or metal hydride, is bonded to the surface of the polarized substrate material by impregnating, soaking, spraying, flowing, immersing or otherwise effectively exposing the substrate surface to the metal salt, oxide, hydroxide or hydride. A preferred method of bonding the salt to the substrate is by impregnating, soaking, or spraying the material with a liquid solution, slurry or suspension or mixture containing the metal salt, oxide, hydroxide or hydride followed by removing the solvent or carrier by drying, heating and/or by applying a vacuum. The substrate may also be impregnated by pumping a salt suspension, slurry or solution or liquid-salt mixture into and through the material. Where the liquid carrier is a solvent for the salt, it may be preferred to use a saturated salt solution for impregnating the substrate. However, for some cases, lower concentrations of salt may be used, for example, where necessitated or dictated to meet permissible loading densities. Where solubility of the salt in the liquid carrier is not practical or possible, substantially homogeneous dispersions may be used. Where an electrostatically charged substrate is used, the salt may be bonded by blowing or dusting the material with dry salt or hydride particle.

As previously described, in some embodiments, it may be necessary to bond a sufficient amount of metal salt, halide, oxide, hydroxide or hydride on the substrate to achieve substantial bridging of the salt, oxide, hydroxide or hydride crystal structure between adjacent fibers and/or strands. A sufficient amount of metal salt, oxide, hydroxide or hydride is provided by at least about 0.3 grams per cc of open substrate volume, preferably at least about 0.4 grams per cc, and most preferably at least about 0.5 grams per cc of open substrate volume for substrates made of glass, aramid or carbon and often less for polyethylene based weaves (for example 0.2 grams/cc to 0.3 grams/cc), which is between about 25% and about 95% of the untreated substrate volume, and preferably between about 50% and about 90% of the untreated substrate volume for most materials except some of the fine polyethylene based weaves. Following the aforesaid treatment, the material is dried in equipment and under conditions to form a flat layer, or other desired size and shape using a mold or form. A dried substrate will readily hold its shape. In one embodiment, the substrate is dried to substantially eliminate the solvent, carrier fluid or other liquid, although small amounts of fluid, for example, up to 1-2% of solvent, can be tolerated without detriment to the strength of the material. Drying and handling techniques for such solvent removal will be understood by those skilled in the art.

The metal salts (mostly halides), oxides or hydroxides bonded to the substrate are alkali metal, alkaline earth metal, transition metal, zinc, cadmium, tin, aluminum, double metal salts of the aforesaid metals, and/or mixtures of two or more of the metal salts. The salts of the aforesaid metals may be halide, nitrite, nitrate, oxalate, perchlorate, sulfate or sulfite. The preferred salts may include halides, and preferred metals may include strontium, magnesium, manganese, iron, cobalt, calcium, barium and lithium. The aforesaid preferred metal salts provide molecular weight/electrovalent (ionic) bond ratios of between about 40 and about 250. Hydrides of the aforesaid metals may also be useful, examples of which are disclosed in U.S. Pat. Nos. 4,523,635 and 4,623,018, incorporated herein by reference in their entirety.

Following the drying step or where the salts are bonded to dry, electrostatically charged substrate, if not previously sized, the material is cut to form layers of a desired size and/or shape, and each layer of metal salt or hydride bonded substrate material or multiple layers thereof are sealed by coating with a substantially water-impermeable composition. The coating step should be carried out under conditions or within a time so as to substantially seal the composite thereby preventing the metal salt or hydride from becoming hydrated via moisture, steam, ambient air, or the like, which may cause deterioration of strength of the material. The timing and conditions by which the coating is carried out will depend somewhat on the specific salt bonded on the substrate. For example, calcium halides, and particularly calcium chloride and calcium bromide will rapidly absorb water when exposed to atmospheric conditions causing liquefaction of the salt and/or loss of the salt bond and structural integrity of the product. Substantially water-impermeable coating compositions include epoxy resin, phenolic resin, neoprene, vinyl polymers such as PBC, PBC vinyl acetate or vinyl butyral copolymers, fluoroplastics such as polychlorotrifluoroethylene, polytetrafluoroethylene, FEP fluoroplastics, polyvinylidene fluoride, chlorinated rubber, and metal films including aluminum and zinc coatings. The aforesaid list is by way of example, and is not intended to be exhaustive. Again, the coating may be applied to individual layers of substrate, and/or to a plurality of layers or to the outer, exposed surfaces of a plurality or stack of substrate layers.

Panels or other forms and geometries such as concave, convex or round shapes of the aforesaid coated substrate composites such as laminates are formed to the desired thickness, depending on the intended ballistic protection desired, in combination with the aforesaid composites to further achieve desired or necessary performance characteristics. For example, useful panels or laminates of such salt bonded woven substrates may comprise 10-50 layers per inch thickness. Such panels or laminates may be installed in doors, sides, bottoms or tops of a vehicle to provide armor and projectile protection. The panels may also be assembled in the form of cases, cylinders, boxes or containers for protection of many kinds of ordnance or other valuable and/or fragile material such as ammunition, fuel and missiles as well as personnel. Laminates may include layers of steel or other ballistic resistant material such as carbon fiber composites, aramid composites or metal alloys.

The aforesaid composites may be readily molded into articles having contoured and cylindrical shapes, specific examples of which include helmets, helmet panels or components, vests, vest panels as well as vehicle protection panels, vehicle body components, rocket or missile housings and rocket or missile containment units, including NLOS (non-line of sight) systems. Such housings and containment units would encase and protect a rocket or missile and are used to store and/or fire missiles or rockets and could be constructed using the composites described herein to protect their contents from external objects such as bullets or bomb fragments. Vest panels of various sizes and shapes may be formed for being inserted into pockets located on or in the lining of existing or traditional military vests. The combined use of such panels with more traditional bulletproof vests may result in a lighter, more flexible, and more readily adaptable vest that accommodates the variety of sizes for different individuals. Similarly, one embodiment is a helmet panel that has been contoured to fit inside as a liner for a traditional helmet. In another embodiment, the protective composite panel is secured on the outside of the helmet with flexible and/or resilient helmet covers, netting, etc. In a different embodiment, the helmet may include one or more contoured or shaped composites as described herein to protect the wearer from bullets or bomb fragments.

For penetration resistant vehicular armor, many different sized and shaped protection panels may be formed of the composite including floor, door, side and top panels as well as vehicle body components contoured in the shape of fenders, gas tank, engine and wheel protectors, hoods, and the like. As used herein, "vehicle" includes a variety of machines, including automobiles, tanks, trucks, helicopters, aircraft and the like. Thus, the penetration resistant vehicle armor may be used to protect the occupants or vital portions of any type of vehicle.

The aforesaid composite articles may also be combined with other ballistic and penetration resistant panels of various shapes and sizes. For example, the aforesaid composites may be paired with one or more layers or panels of materials such as steel, aramid resins, carbon fiber composites, boron carbide, or other such penetration resistant materials known to those skilled in the art including the use of two or more of the aforesaid materials, depending on the armor requirements of the penetration resistant articles required.

By way of example, a woven glass fiber substrate bonded with strontium chloride was formed according to the previously described procedure at a concentration of 0.5 grams salt per cc of open substrate space. Layers of the substrate were coated with epoxy resin and formed in a panel 12.5 in.×12.5 in.×0.5 in. thick. The panel weighed 4.71 pounds, having material density of 0.06 pounds per cubic inch, comparing to 22% of the density of carbon steel. Bullets fired from a military-issued Berretta gun firing 9 mm 124-grain FMG bullets (9 g PMC stock number, full metal jacket), at 20 yards did not fully penetrate the panel.

III. Overview of Example Anti-Ballistic Articles

FIG. 1A illustrates an example of a projectile-resistant enclosure 10 having walls 20 comprising the anti-ballistic articles described herein. As illustrated, the walls 20 can include three panels: a first composite panel 25 and second composite panel 30 and a stress mitigation panel 28 disposed between the exterior composite panel 25 and interior composite panel 30. Enclosure 10 can be used to protect equipment or personnel, for example as a room on board a ship or aircraft, or can be a storage or transport container. Due to the possibly large size of enclosure 10, the lightweight paneled penetration resistant composites described herein can be beneficial for providing ballistic protection while complying with weight limitations that can be due to usage of enclosure 10 on or within a vehicle.

Figure 1B:
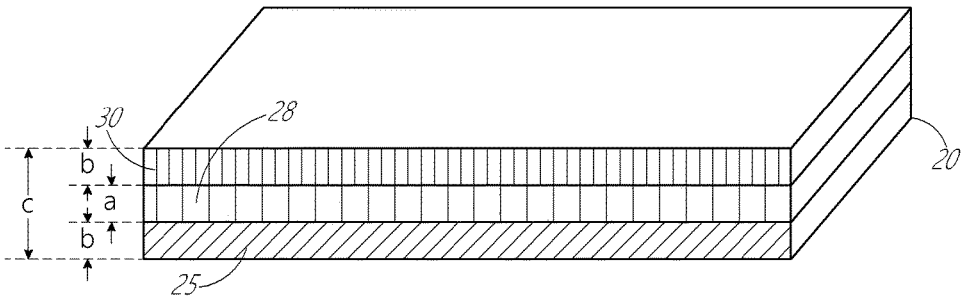
FIG. 1B illustrates a cross-sectional view of one embodiment of the walls of the enclosure of FIG. 1A.

FIG. 1B illustrates a cross-sectional view of one embodiment of the walls of the enclosure of FIG. 1A. As illustrated, the walls 20 can include the three panels discussed above: a first composite panel 25 and second composite panel 30 and a stress mitigation panel 28 disposed between the composite panels 25, 30. In other embodiments, walls 20 can include more composite panels and intermediate stress mitigation panels. Composite panels 25, 30 can include one or more layers of a woven penetration-resistant composite such as those described above, and the layers of a panel can have the same composition or different compositions as each other and the layers of the other panel, depending on the application.

The stress mitigation panel 28 can comprise a lightweight material such that a weight of the mixed stack of composite panels 25, 30 and the stress mitigation panel 28 is less than the weight of a stack including only composite panels. In some implementations, the stress mitigating panel 28 includes a compressible material and/or ductile material. For example, one suitable material can be foam, for example open-cell foam/reticulated foam, and the like.

In other implementations, the stress mitigating panel 28 can be a frame, a spacing grid or matrix, or a lightweight 3D knitted spacing fabric configured to create a gap between proximate composite panels. For example, a frame can extend at least around the edges of the composite panels to maintain a desired spacing gap between proximate composite panels. The gap between composite panels can be filled with gas (for example air) or liquid in some embodiments.

In other implementations, the stress mitigating panel 28 can comprise a hard, brittle material that cracks or shatters at projectile impact speeds in order to redirect and/or absorb force/stress propagating in the direction of projectile travel, or to mitigate deformation of the impacted composite panel.

As illustrated, each composite panel 28, 30 can have a thickness b and the stress mitigating panel 28 can have a thickness a, with a total thickness c representing all three panels 25, 28, 30 stacked together. In some implementations, composite panels 28, 30 can have different thicknesses than one another. Some examples of composite panels 28, 30 can have thicknesses between 0.2" and 1.0". In one example, a desired ratio of the stress mitigating panel 28 to total thickness of the two composite panels 25, 30 with the stress mitigating panel 28, a:c, can be between 1:10 and 1:2. In another example, a thickness of the stress mitigating panel 28 is 10% to 50% of the overall thickness c of the multi-panel ballistic composite article. Of course it should be realized that embodiments are not limited to having only a single stress mitigation panel disposed between two protective panels. For example, the penetration resistant article may include 3, 4, 5, 6, 7 or more protective panels with a stress mitigation panel disposed between each protective panel.

In other embodiments, the composite panels 25, 30 of enclosure 10 may have regions of varying density, as described in more detail with respect to FIG. 4, below. In such embodiments, the stress mitigating panel 28 may be of a reduced thickness or may even be omitted due to the stress mitigation capabilities of the layer density variation. Alternatively, the stress mitigating panel 28 may be of the described width together with having layer density variation within the composite panels 25, 30.

Accordingly, the enclosure 10 may be able to stop, or at least reduce the impact velocity of, incoming projectiles more effectively than enclosures with the same thickness, but having no stress mitigation panels. For example, in some implementations the walls 20 can be configured with sufficient composite panels and intermediate stress mitigating panels to reduce the speed of an impacting projectile traveling at an impact velocity of approximately 8,300 ft/s by approximately half. The enclosure 10 having walls 20 including the anti-ballistic article having both penetration resistant composite panels and stress mitigating panels disposed between composite panels may accomplish such velocity reductions at a fraction of the weight of multi-paneled penetration resistant articles having composite panels alone, and using less composite panels.

Figure 2A:
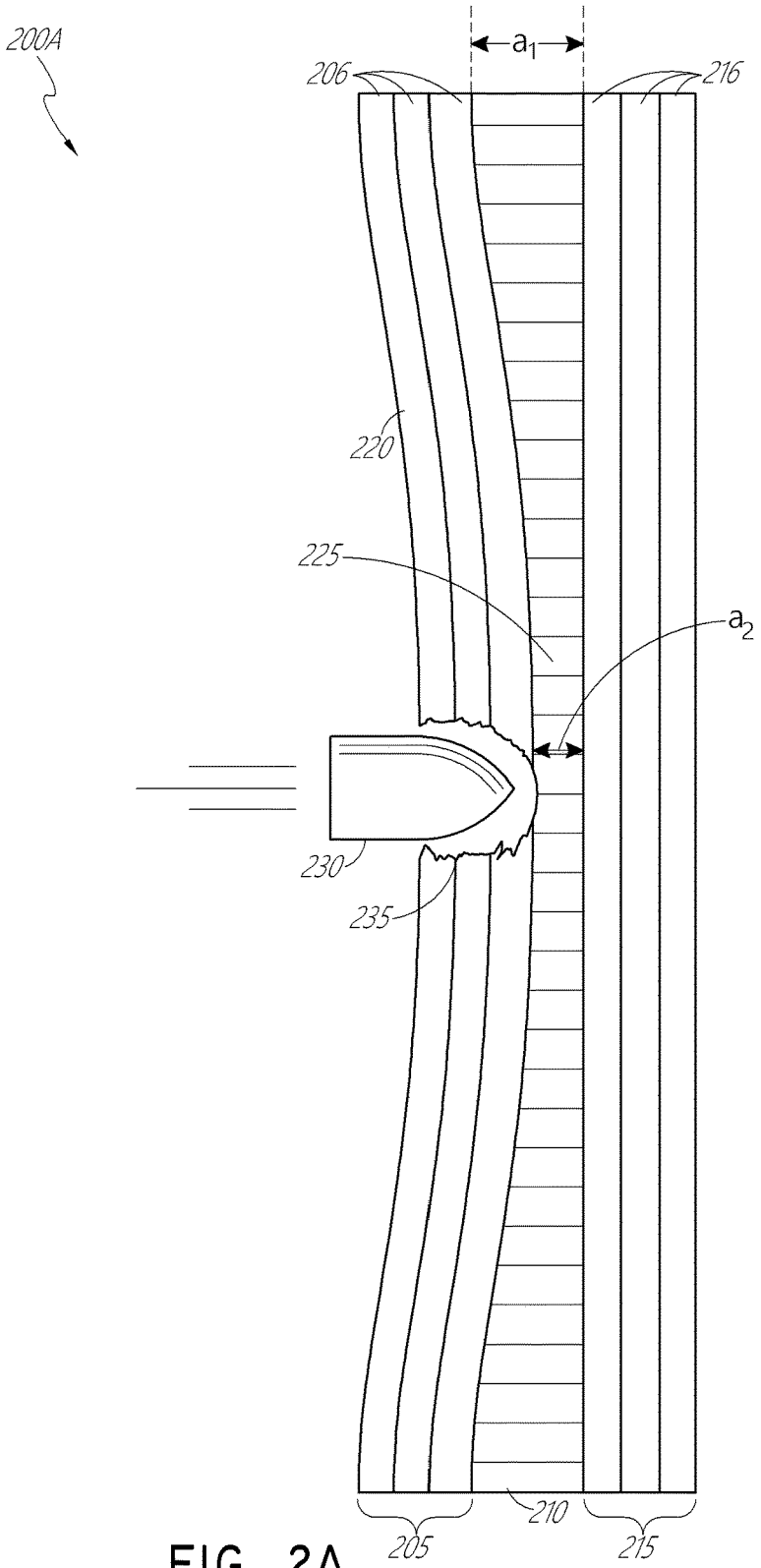
FIG. 2A illustrates a schematic diagram of a cross-section of one embodiment of a projectile impacting a penetration resistant composite article with a compressible intermediate panel.

FIG. 2A illustrates a schematic diagram of a cross-section of one embodiment of a projectile 230 impacting a penetration resistant composite article 200A stacked with a compressible stress mitigating panel 210. As shown, the compressible stress mitigating panel 210 is disposed between first and second penetration-resistant composite panels 205, 215. Each composite panel 205, 215 is comprised of multiple composite layers 206, 216, respectively. Although panel 205 is illustrated as having three layers 206 and panel 215 is illustrated as having three layers 216, the panels can have greater or fewer layers and can have different numbers of layers from one another. In some embodiments, the layers of a panel 205, 215 may have different densities from one another. Penetration-resistant composite panels 205, 215 can comprise the composites described above, for example having a plurality of layers of woven fabric of polarized ballistic fibers, wherein a metal salt, oxide, hydroxide or hydride are polar bonded onto the polarized ballistic fibers.

Although only one compressible stress mitigating panel 210 is shown, some embodiments may use multiple compressible stress mitigating panels to mitigate stress propagation between first composite panel 205 and second composite panel 215.

The compressible stress mitigating panel 210 has an uncompressed width of $a_1$ corresponding to the gap between composite panels 205, 215. However, as projectile 230 impacts the first composite panel 205 (here, first refers to the impact-facing side of the penetration resistant composite 200A) and deforms a portion 220 of the first composite panel 205 around the impact site 235, the compressible stress mitigating panel 210 has a compressed width of $a_2$ resulting from the deformation of first composite panel 205 in the direction of projectile travel. The compressed width of $a_2$ is sufficient to isolate the deformation of first composite panel 205 so that the second composite panel 215 is not weakened by the deformation 220 of the first composite panel 205 and thus retains its penetration-resisting potential.

As will be understood, if the first composite panel 205 and second composite panel 215 were directly adjacent one another, without the stress mitigating panel 210, the deformation 220 of the first composite panel 205 would press against and deform the second composite panel 215, thereby weakening the second composite panel 215 (for example weakening the composite crystal interlocking) before the projectile 230 impacted the second composite panel 215. Therefore, the stress mitigating panel 210 functions to isolate (or substantially isolate) deformation of the first panel 205 to avoid (or substantially avoid) pre-stressing the second panel 215 prior to projectile impact.

Figure 2B:
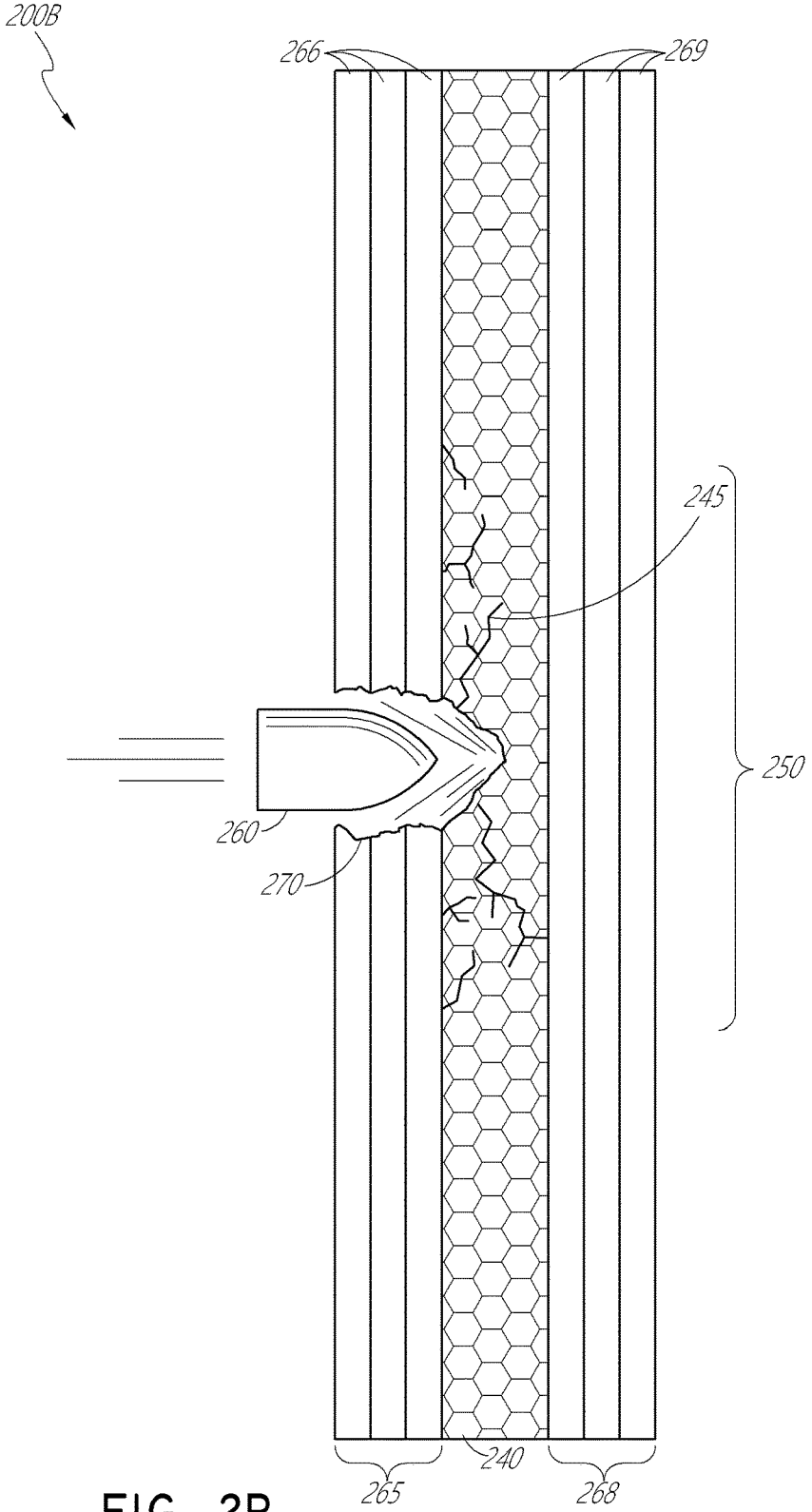
FIG. 2B illustrates a schematic diagram of a cross-section of one embodiment of a projectile impacting a penetration resistant composite article with a force dispersing intermediate panel.

FIG. 2B illustrates a schematic diagram of a cross-section of one embodiment of a projectile 260 impacting a penetration resistant composite 200B stacked with a force dispersing stress mitigating panel 240. As shown, the force dispersing stress mitigating panel 240 is disposed between first and second penetration-resistant composite panels 265, 268, with each of the composite panels 265, 268 comprising a number of layers 266, 269. Although panel 265 is illustrated as having three layers 266 and panel 268 is illustrated as having three layers 269, the panels can have greater or fewer layers and can have different numbers of layers from one another. In some embodiments, the layers of a panel 265, 268 may have different densities from one another. Force dispersing stress mitigating panel 240 comprises, in some embodiments, a brittle material configured to shatter, rather than deform, under impact in order to substantially mitigate stress propagation into composite panel 268. For example, force dispersing stress mitigating panel 240 can redirect and/or absorb the kinetic force of the projectile in its direction of travel or to mitigate deformation of the composite panel 268. In some examples, force dispersing stress mitigating panel 240 can be a ceramic such as boron carbide or silicon carbide.

As projectile 260 impacts the first composite panel 265 at the impact site 270, the force dispersing stress mitigating panel 240 can resist deformation of the first panel 265, instead dispersing the force from impact laterally (that is, perpendicularly to the direction of projectile travel) thereby spreading the force across an area 250. As a result, cracks 245 may form in force dispersing stress mitigating panel 240. In this manner, the force dispersing stress mitigating panel 240 can mitigate the stress propagation from the first composite panel 265 to the second composite panel 268.

In other embodiments, instead of comprising a material configured to shatter upon impact, the stress mitigating panel can comprise a non-compressible liquid that mitigates the stress propagation from the first composite panel into the second composite panel by distributing the force caused by deformation of the first panel across some or all of the surface area of the liquid. In some embodiments, the penetration resistant composite articles 200A, 200B can be sealed to be waterproof. For example, the penetration resistant composite articles 200A, 200B can be sealed within a waterproof material in the shape of a foil, wrap, coating or encasing, or a waterproof material comprising an epoxy, plastic or metal.

Figure 3A:
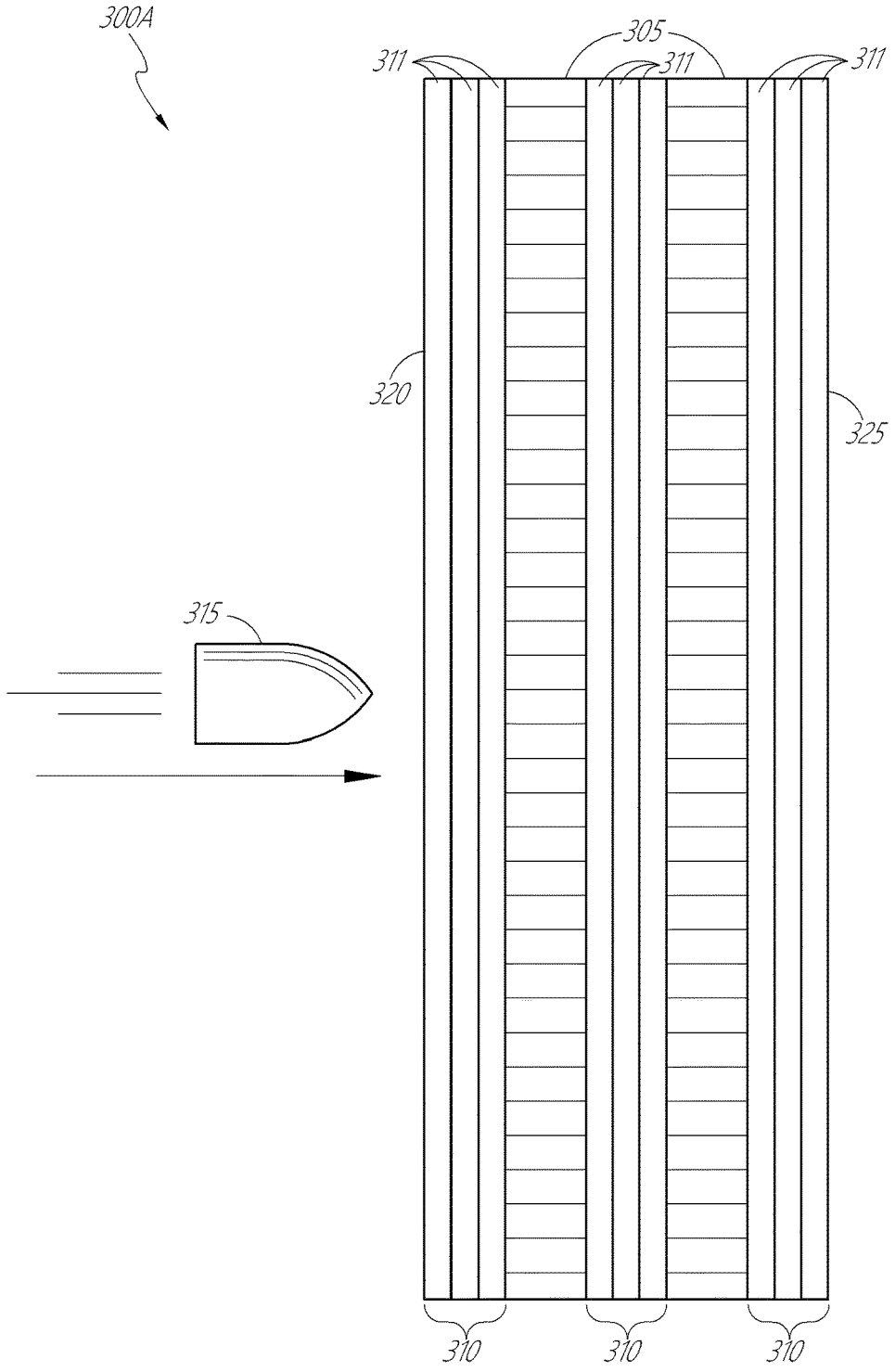
FIGS. 3A-3C illustrate various embodiments of example panel configurations for a multilayered penetration resistant composite stack.
Figure 3B:
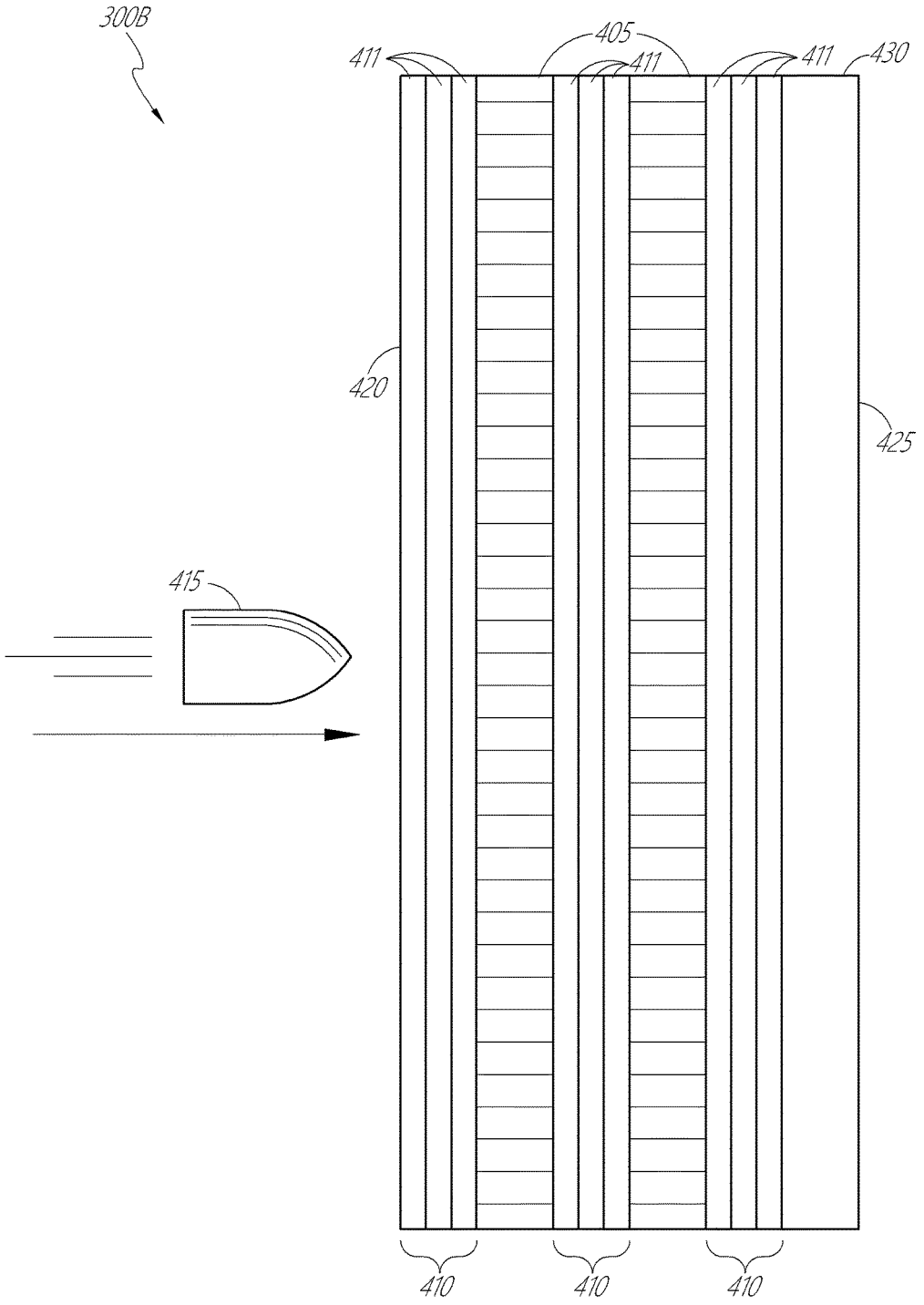
Figure 3C:
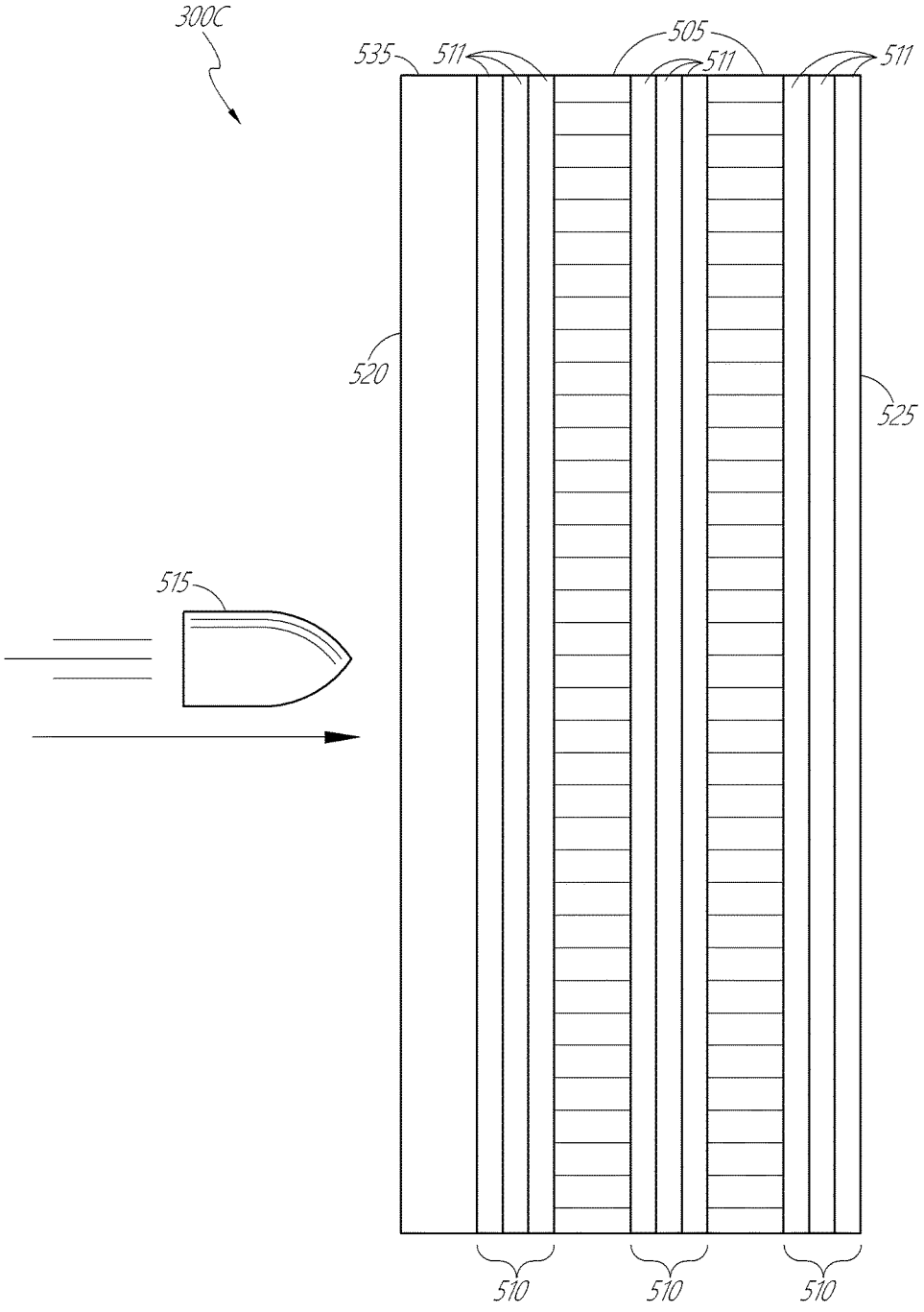

FIGS. 3A-3C illustrate various embodiments of example panel configurations 300A, 300B, 300C for a multi-panel penetration resistant article. In FIGS. 3A-3C, the penetration resistant composite panels 310, 410, 510 can be any of the compositions described above, for example having a plurality of layers 311, 411, 511 of woven fabric of polarized ballistic fibers, wherein a metal salt, oxide, hydroxide or hydride are polar bonded onto the polarized ballistic fibers. The layers 311, 411, 511 within a panel 310, 410, 510 can have varying densities in some embodiments.

The stress mitigating panels of FIGS. 3A-3C can be any type of stress mitigating panels as described above, for example a compressible panel, brittle panel, an air gap, a frame, matrix, or other structure for forming a gap, or a liquid panel. In some embodiments, a stress mitigating panel 305, 405, 505 can be a combination of the stress mitigating panels described above. For example, stress mitigating panel 305, 405, 505 can include both a force dispersing panel positioned to absorb the impact stress of an incoming projectile after impacting a first composite panel and a compressible panel disposed between the force dispersing projectile and the next composite panel to cushion the next composite panel from any stress cracking of the force dispersing panel. Another example of stress mitigating panel can include both the force dispersing panel and the compressible panel, with the compressible panel positioned adjacent to the first-impacted composite panel and the force dispersing panel positioned between the compressible panel and the next composite panel to prevent excess deformation of the first composite panel from pre-stressing the next composite panel.

In some embodiments, the penetration resistant composites 300A, 300B, 300C can be sealed to be waterproof. For example, the penetration resistant composites 300A, 300B, 300C can be sealed within a waterproof material in the shape of a foil, wrap, coating or encasing, or a waterproof material comprising an epoxy, plastic or metal.

FIG. 3A illustrates an example panel configuration for a mixed panel penetration resistant composite article 300A having three penetration resistant composite panels 310 comprised of composite layers 311 having stress mitigating panels 305 disposed between the composite panels 310. Other embodiments can have greater or fewer penetration resistant composite panels 310 with corresponding intermediate stress mitigating panels 305 as needed to achieve the desired projectile impact velocity reduction characteristics of the penetration resistant composite article 300A. As shown, the penetration resistant composite article 300A has an impact-facing side 320 that would be first impacted by the projectile 315 and an opposing side 325 that would be proximate to the person or equipment that the penetration resistant composite article 300A was positioned to protect. Because of the intermediate stress mitigating panels 305, the mixed panel penetration resistant composite article 300A can provide for greater reduction of the impact velocity of a projectile 315 than an article including a corresponding number of directly adjacent composite panels. Where lightweight materials are selected for stress mitigating panels 305, the mixed panel penetration resistant composite article 300A can weigh less than a composite-only article having directly adjacent composite panels that provide similar penetration resisting capabilities.

FIG. 3B illustrates a penetration resistant composite article 300B that is a variation of the panel configuration of FIG. 3A, having three penetration resistant composite panels 410 comprised of composite layers 411 with stress mitigating panels 405 disposed between the composite panels 410 and a hardened panel 430 at the opposing side 425 of the penetration resistant composite article 300B. The illustrated configuration is provided for purposes of example, and other embodiments than the one depicted may have greater or fewer penetration resistant composite panels 410 with corresponding intermediate stress mitigating panels 405 as needed to achieve the desired projectile impact velocity reduction. Hardened panel 430 can comprise a ceramic, metal, or other suitably hard material to stop the projectile 415 after passage through the composite panels 410 and stress mitigating panels 405 has sufficiently slowed the projectile 415.

The penetration resistant composite article 300B having the hardened panel 430 at the opposing side 425 can be suitable, in some examples, for wearable armor or other anti-ballistic purposes where stopping, rather than merely slowing, the projectile is desired. Though not depicted, in some wearable embodiments the penetration resistant composite article 300B may further include a force-absorbing panel between hardened panel 430 and the body of a user in order to cushion the user from the force of the projectile 415 impacting the hardened panel 430.

Although shown as separate structures, in some embodiments the hardened panel 430 can be integrated into the adjacent composite panel 410, for example as a hardened woven layer or layers of the layers 411 at the opposing side 425 of the panel 410.

FIG. 3C illustrates a penetration resistant composite article 300C that is a variation of the panel configuration of FIG. 3A, having three penetration resistant composite panels 510 comprising layers 511 with stress mitigating panels 505 disposed between the composite panels 510 and a hardened panel 535 at the impact-facing side 520 of the penetration resistant composite article 300C. The illustrated configuration is provided for purposes of example, and other embodiments than the one depicted may have greater or fewer penetration resistant composite panels 510 with corresponding intermediate stress mitigating panels 505 as needed to achieve the desired projectile impact velocity reduction. Hardened panel 530 can comprise a ceramic, metal, or other suitably hard material to break off drill bits of some armor-piercing projectiles. Accordingly, the penetration resistant composite article 300C having the hardened panel 535 at the impact-facing side 520 can be suitable, in some examples, for resisting armor-piercing projectiles that may, if their drill bits are not broken off prior to entering the composite panels 510, tear through the composite panels 510.

Although shown as separate structures, in some embodiments the hardened panel 535 can be integrated into the adjacent composite layer 510, for example as a hardened woven layer or layers of the layers 511 at the opposing side 520 of the panel 510.

Figure 4:
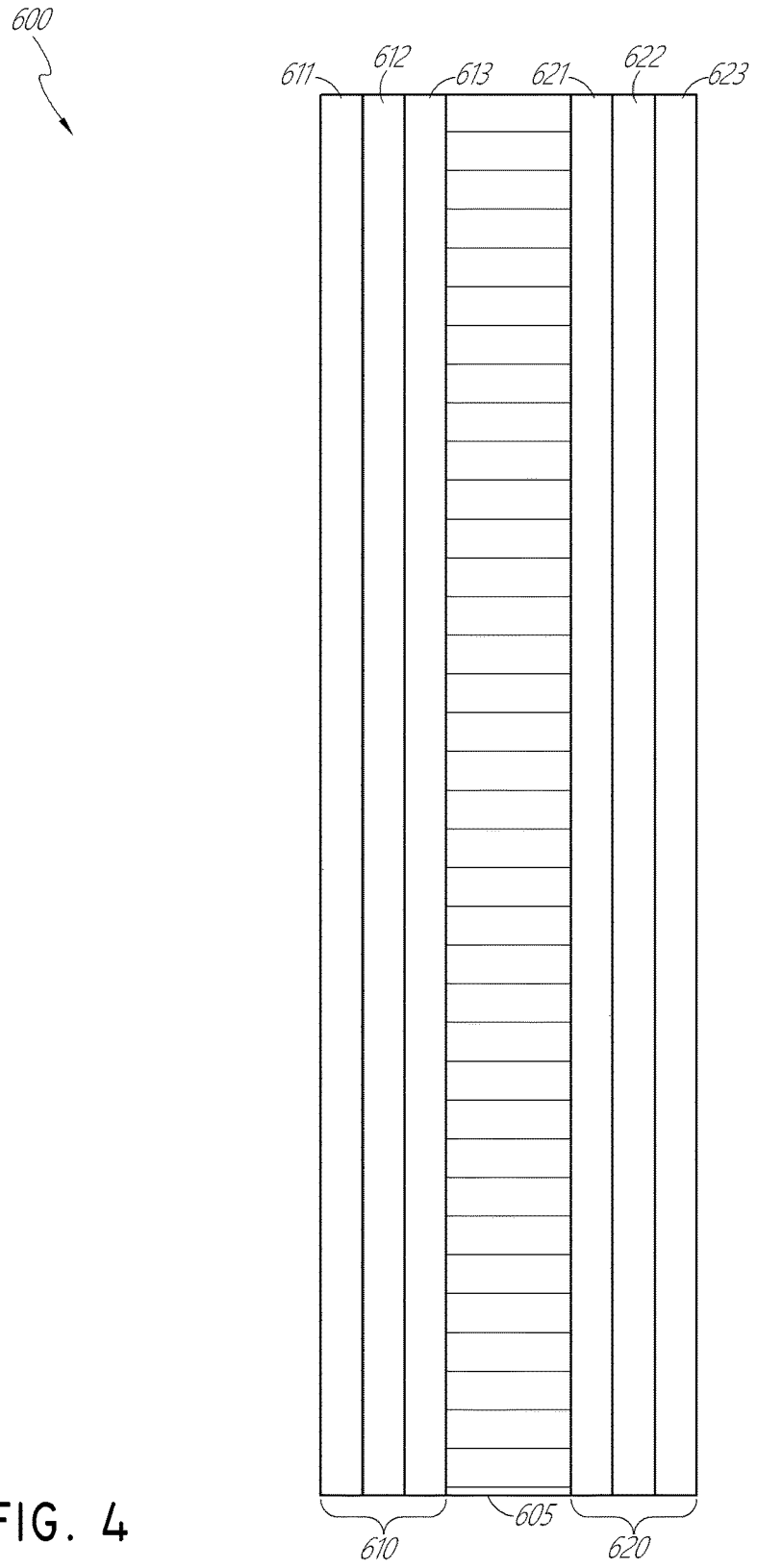
FIG. 4 illustrates an embodiment of a multi-paneled composite article having composite panels with layers of varying density.

FIG. 4 illustrates an embodiment of a multi-paneled composite article 600 having composite panels 610, 620 with layers of varying density and a stress mitigation panel 605. Stress mitigation panel 605 can be any of the stress mitigation panels described above, for example a compressible material, brittle material, or gap.

As illustrated, first outer panel 610 includes three density regions: a first region 611 having a high density, a second region 612 having a medium density, and a third region 613 having a low density. For example, first region 611 may be made with a salt loading density of 0.6 g/cm, second region 612 may be made with a salt loading density of 0.4 gm/cm and third region 613 may act as a stress mitigation region and be made with a salt loading density of 0.2 gm/cm. Each region 611, 612, 613 can include one or more composite layers or woven fabric. Similarly, second inner panel 620 includes three loading density regions: a first region 621 having a high density, a second region 622 having a medium density, and a third region 623 having a low density. For purposes of simplicity, each region 611, 612, 613, 621, 622, 623 is illustrated as a single layer, however each region can include one or more composite layers. The composite layers of panels 610, 620 can be made of any of the substrates and bonded materials described above. Although three density regions are shown, other embodiments of panels 610, 620 may have two, or four or more, different density regions. Density regions can be arranged, as illustrated, from greatest density to lowest density, or can be arranged in repeating pattern of two or more different density regions.

In some embodiments, the high density region 611 can be positioned at the impact-facing side of the article 600. When a ballistic projectile contacts the high density region 611 of panel 610, it may deform that region or first layers within the region 611. That deformation may result in a shock wave, or pieces of the impacted layers, impacting the layer(s) in adjacent region(s) 612, 613 in the panel 610. The relatively lower density of these regions 612, 613 may allow the shock wave or debris to dissipate prior to reaching the second panel 620.

Although the article 600 is illustrated with stress mitigation panel 605, in some embodiments the article 600 can omit the stress mitigation panel 605 entirely. Thus, in this embodiment, each panel having differing densities is placed adjacent one another and the area of reduced density within each panel acts as a stress mitigation layer due to its reduced density. In other embodiments, stress mitigation panel 605 can be included but can have a relatively smaller thickness compared to articles with homogenously dense composite panels.

In one embodiment, the ballistic article is made up of a plurality of panels, wherein each panel has a first area of high density, and a second stress mitigation region of reduced density. In this embodiment, the panels are placed directly adjacent one another and the second areas of reduced density within each panel act as stress mitigation region to reduce the pre-stress force of the projectile as it traverses each panel.

In another embodiment, the entire article 600 is made from a single panel that includes regions of fabric providing varying composite densities within the panel, as discussed above.

IV. Other Embodiments

Although discussed herein primarily in the context of an enclosure, it will be appreciated that the mixed, multi-paneled penetration resistant composite articles described above can be implemented in a variety of other circumstances. The penetration resistant composite articles can also be implemented as wearable body armor or vehicle armor, for example as a protective layer over the bottom of a helicopter.

V. Terminology

Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

While certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future.

What is claimed is:

1. A multi-panel ballistic composite article, comprising:

a first panel;

a stress mitigation panel disposed adjacent to the first panel; and a second panel disposed adjacent the stress mitigation panel, wherein the first panel and the second panel each comprise a plurality of layers of woven fabric of polarized ballistic fibers, wherein a metal salt, oxide, hydroxide or hydride are polar bonded onto the polarized ballistic fibers, and wherein the stress mitigation panel is configured to substantially mitigate stress propagation into the second panel caused by deformation of the first panel, and wherein the stress mitigation panel comprises a different material than the woven fabric of polarized ballistic fibers of the first and second panels, wherein the different material has a lower density and higher compressibility than the first and second panels.

2. The multi-panel ballistic composite article of claim 1, wherein the different material comprises foam.

3. The multi-panel ballistic composite article of claim 1, wherein the stress mitigation panel comprises a frame or grid structure configured to substantially mitigate the stress propagation into the second panel.

4. The multi-panel ballistic composite article of claim 1, wherein a thickness of the second panel is 10% to 50% of the overall thickness of the multi-panel ballistic composite article.

5. The multi-panel ballistic composite article of claim 1, further comprising:

a third panel disposed adjacent to the second panel; and a fourth panel disposed adjacent the third panel, wherein the third panel is configured to substantially mitigate stress propagation into the fourth panel caused by deformation of the third panel, and wherein the fourth panel comprises a plurality of layers of woven fabric of polarized ballistic fibers, wherein a metal salt, oxide, hydroxide or hydride are polar bonded onto the polarized ballistic fibers.

6. The multi-panel ballistic composite article of claim 5, wherein the third panel comprises a compressible material configured to substantially mitigate the stress propagation into the fourth panel.

7. The multi-panel ballistic composite article of claim 6, wherein the compressible material comprises foam, cloth, or woven material.

8. The multi-panel ballistic composite article of claim 5, wherein the fourth panel has an inner layer and an outer layer, and the outer layer is hardened to be less prone to deformation as compared to the inner layer.

9. The multi-panel ballistic composite article of claim 1, wherein the metal salt comprises one or more of an alkali metal, alkaline earth metal, transition metal, zinc, cadmium, tin, aluminum, or double metal salts.

10. The multi-panel ballistic composite article of claim 1, wherein the second panel has an inner layer and an outer layer, and the outer layer is hardened to be less prone to deformation as compared to the inner layer.

11. The multi-panel ballistic composite article of claim 10, wherein a loading density of woven fabric in the outer layer is greater than about 0.40 g/cc of open fabric volume.

12. The multi-panel ballistic composite article of claim 10, wherein the outer layer comprises a ceramic.

13. The multi-panel ballistic composite article of claim 12, wherein the ceramic comprises silicon carbide, boron carbide, aluminum oxide, silicates, or mixtures thereof.

14. The multi-panel ballistic composite article of claim 1, wherein the thickness of the first panel is the same as the thickness of the second panel.

15. The multi-panel ballistic composite article of claim 1, wherein the thickness of the first panel is different than the thickness of the second panel.

16. The multi-panel ballistic composite article of claim 1, wherein the composition of compounds bound to woven fabric of the first panel is different than the composition of compounds bound to woven fabric of the second panel.

17. The multi-panel ballistic composite article of claim 1, wherein the first panel has an inner layer and an outer layer, and the inner layer is hardened to be less prone to deformation than the outer layer.

18. The multi-panel ballistic composite article of claim 17, wherein a loading density of woven fabric in the inner layer is greater than about 0.40 g/cc of open fabric volume.

19. The multi-panel ballistic composite article of claim 1, wherein a loading density salt bound to the woven fabric of the first panel and the second panel varies from 0.2 g/cc to about 0.60 g/cc of open fabric volume.

20. The multi-panel ballistic composite article of claim 1, wherein the composite article comprises an article of body armor, vehicle armor or panels for storage or transport containers.

21. The multi-panel ballistic composite article of claim 1, wherein the first panel or the second panel, or both, comprise S-2 glass, polyamide, polyphenylene sulfide, polyethylene, high modulus polyethylene, carbon or graphite fibers.

22. The multi-panel ballistic composite article of claim 1, wherein the article is sealed within a waterproof material.

23. The multi-panel ballistic composite article of claim 1, wherein the different material has an uncompressed width corresponding to a gap between the first and second panels, wherein the different material is configured to have a compressed width resulting from the deformation of the first panel into the stress mitigation panel, and wherein the uncompressed width is greater than the amount of the deformation of the first panel in the direction of projectile travel such that the compressed width isolates the second panel from the deformation of the first panel.

24. A multi-panel ballistic composite article, comprising:

a first panel;

a second panel, wherein the first panel and the second panel each comprise a plurality of layers of woven fabric of polarized ballistic fibers, wherein a metal salt, oxide, hydroxide or hydride is polar bonded onto the polarized ballistic fibers; and a stress mitigation panel disposed between and adjacent to the first panel and the second panel, wherein the stress mitigation panel comprises foam or an air gap configured to substantially mitigate stress propagation into the second panel caused by deformation of the first panel.

25. The multi-panel ballistic composite article of claim 24, wherein the stress mitigation panel comprises the air gap and a spacing grid, matrix, or lightweight 3D knitted spacing fabric configured to create the air gap.

26. The multi-panel ballistic composite article of claim 24, further comprising:

a third panel disposed adjacent to the second panel; and a fourth panel disposed adjacent the third panel, wherein the fourth panel comprises a plurality of layers of woven fabric of polarized ballistic fibers, wherein a metal salt, oxide, hydroxide or hydride is polar bonded onto the polarized ballistic fibers, wherein the third panel comprises the foam or the air gap and is configured to substantially mitigate stress propagation into the fourth panel caused by deformation of the third panel.

27. The multi-panel ballistic composite article of claim 26, wherein the third panel comprises the air gap and a spacing grid, matrix, or lightweight 3D knitted spacing fabric configured to create the air gap.

* * * * *